US008131202B2

(12) United States Patent
Hirota

(10) Patent No.: US 8,131,202 B2
(45) Date of Patent: Mar. 6, 2012

(54) IMAGE FORMING APPARATUS HAVING SPUR UNIT FOR REGULATING CONVEYANCE OF SHEET

(75) Inventor: Kiyohito Hirota, Chiba (JP)

(73) Assignee: Seiko I Infotech Inc. (JP)

( * ) Notice: Subject to any disclaimer, the term of this patent is extended or adjusted under 35 U.S.C. 154(b) by 655 days.

(21) Appl. No.: 12/012,830

(22) Filed: Feb. 6, 2008

(65) Prior Publication Data

US 2008/0199236 A1 Aug. 21, 2008

(30) Foreign Application Priority Data

Feb. 17, 2007 (JP) ..... 2007-037231
Dec. 4, 2007 (JP) ..... 2007-313517

(51) Int. Cl.
*G03G 15/00* (2006.01)

(52) U.S. Cl. ..... 399/400; 399/397; 399/122; 399/68

(58) Field of Classification Search ..... 399/400, 399/397, 33, 68, 122
See application file for complete search history.

(56) References Cited

U.S. PATENT DOCUMENTS 5,636,929 A * 6/1997 Asano et al. ..... 400/641
6,205,316 B1 * 3/2001 Iida ..... 399/323
6,276,680 B1 * 8/2001 Sonoda et al. ..... 271/273
7,130,575 B2 * 10/2006 Maruko et al. ..... 399/405
7,602,513 B2 * 10/2009 Uwagaki et al. ..... 358/1.15

FOREIGN PATENT DOCUMENTS

| | | | |
|---|---|---|---|
| JP | 56052750 | | 5/1981 |
| JP | 02072252 | | 6/1990 |
| JP | 04366858 | A * | 12/1992 |
| JP | 2006301335 | | 11/2006 |
| JP | 2006301536 | | 11/2006 |
| JP | 2006315787 | | 11/2006 |
| JP | 2006317626 | | 11/2006 |

* cited by examiner

*Primary Examiner* — Matthew G Marini
(74) *Attorney, Agent, or Firm* — Adams & Wilks

(57) ABSTRACT

An image forming apparatus has an image transferring portion for transferring an image onto a sheet, an image fixing portion for fixing the transferred image to the sheet, a sheet conveyor portion arranged between the image transferring portion and the image fixing portion for conveying the sheet in a sheet conveying direction, a support portion having an elliptical-shaped shaft hole extending in a direction crossing the sheet conveying direction, and an arm rotatably mounted on the support portion. A first spur is disposed at a position opposed to the sheet conveyor portion and is rotatably supported by the support portion and movable along the shaft hole. A second spur is disposed at a position opposed to the sheet conveyor portion downstream in a sheet conveying direction of the first spur and closer to the sheet conveyor portion than the first spur. The second spur is rotatably supported by the arm and has a movable range larger than a movable range of the first spur.

18 Claims, 3 Drawing Sheets

IMAGE FORMING APPARATUS HAVING SPUR UNIT FOR REGULATING CONVEYANCE OF SHEET

BACKGROUND OF THE INVENTION

1. Technical Field

The present invention relates to an image forming apparatus such as a copier, a printer, or a facsimile.

2. Background Art

As an image forming apparatus, there is known an image forming apparatus of a so-called electrophotographic type. In the image forming apparatus of the electrophotographic type, a toner image formed on a photosensitive body is transferred onto a sheet in an image transferring portion. A sheet on which an unfixed toner image is placed is removed from a photosensitive body to be conveyed on a sheet conveyor portion to downstream, and the toner image is fixed to the sheet in the image fixing portion. The sheet to which the toner image is fixed is further conveyed to be delivered to a delivery portion.

When a leading edge of the sheet onto which the toner image is transferred in the image transferring portion and which is removed from the image transferring portion is curled upwardly or downwardly, or floats from the sheet conveyor portion, the leading edge of the sheet cannot smoothly enter a nip portion between a fixing roller and a pressure roller which constitute an image fixing portion. Accordingly, at a position opposed to the sheet conveyor portion, there is provided a spur for regulating the sheet which is in a curled state or a floating state (see, Patent Document 1).

FIGS. 3A, 3B and 3B are views each showing a main structure of a related-art image forming apparatus.

As shown in FIG. 3A, the image forming apparatus includes a photosensitive drum 101 constituting the image transferring portion, and a fixing roller 104 and a pressure roller 105 constituting the image fixing portion. Between the photosensitive drum 101 and the image fixing portion, the sheet conveyor portion is formed by a conveying portion 102 for conveying the sheet and a guide plate 103 for guiding the sheet conveyed by the conveying portion 102 to an image fixing portion. Further, at a position opposed to the guide plate 103, there is provided a spur 112 for regulating the sheet which is in the curled state or the floating state. The spur 112 is rotatably supported by the support portion 111 fixed to a stay 110 of the image forming apparatus. A plurality of spur units each including the spur 112 and the support portion 111 for supporting the spur 112 are arranged in a width direction of the sheet.

[Patent Document 1] Japanese Patent Application Laid-open No. 2006-317626

SUMMARY OF THE INVENTION

As shown in FIGS. 3A, 3B and 3C, in a structure including the spur 112, even in a case where the sheet is conveyed on the sheet conveyor portion in a state where the sheet is curled or floating to a certain degree, in order to allow the sheet to be sent to the image fixing portion without being brought into contact with or being caught by the support portion 111, it is necessary that the guide plate 103 and the spur 112 be provided at a certain interval. This is because, when the sheet is brought into contact with the support portion 111, the unfixed toner image on the sheet is blurred, and, when the sheet is caught by the support portion 111, there is a risk of clogging of the sheet.

According to the structure shown in FIGS. 3A, 3B and 3C, in a case where the sheet is conveyed on the sheet conveyor portion while being curled downwardly to a large degree as shown in FIG. 3B, the sheet is regulated toward the sheet conveyor portion by the spur 112. Accordingly, it is possible to prevent the sheet from being brought into contact with or being caught by the support portion 111. However, the spur 112 is spaced apart from the guide plate 103, so the sheet cannot be conveyed along the guide plate 103. Thus, the leading edge of the sheet cannot be sent toward the nip portion between the fixing roller 104 and the pressure roller 105.

In a case where the leading edge of the sheet is not sent toward the nip portion between both the rollers 104 and 105, the leading edge of the sheet eventually abuts on one of the rollers 104 and 105. In this case, the leading edge of the sheet is normally sent to the nip portion by being guided by the rotating rollers 104 and 105. However, in some cases, there is such a risk that the sheet is not favorably sent to the nip portion, thereby causing clogging or being folded. Further, when the leading edge of the sheet abuts on the rollers 104 and 105, conveyance of the sheet is stopped at that moment. In this case, there may be caused blur in the toner image transferred from the photosensitive drum 101 onto the sheet. For those reasons, it is desirable that the leading edge of the sheet be sent toward the nip portion between both the rollers 104 and 105.

FIG. 3C shows a state where the sheet which is curled upwardly is conveyed on the sheet conveyor portion. With a structure shown in FIGS. 3A, 3B and 3A, even in a state where the sheet is curled upwardly, the sheet can be regulated toward the sheet conveyor portion by the spur 112. However, the sheet is still curled upwardly, so the leading edge of the sheet is not sent to the nip portion and abuts on the fixing roller 104. Thus, there is a risk of the same problem as described above occurring.

Note that as means for making the interval between the spur 112 and the guide plate 103 narrow, it is conceived to use a spur with a larger diameter. However, when the spur is increased in diameter, a size of the image forming apparatus increases, thereby not being preferable means.

SUMMARY OF THE INVENTION

It is therefore an object of the present invention to provide an image forming apparatus enabling conveying a sheet along a sheet conveyor portion without increasing a size of the image forming apparatus.

In order to achieve the above-mentioned object, an image forming apparatus according to the present invention including: an image transferring portion for transferring an image onto a sheet; an image fixing portion for fixing the image transferred onto the sheet to the sheet; and a sheet conveyor portion arranged between the image transferring portion and the image fixing portion, is characterized by including: a first spur disposed at a position opposed to the sheet conveyor portion; and a second spur disposed at a position opposed to the sheet conveyor portion downstream in a sheet conveying direction of the first spur and closer to the sheet conveyor portion than the first spur.

According to the image forming apparatus of the present invention, the sheet conveyed from the image transferring portion onto the sheet conveyor portion is regulated toward the sheet conveyor portion by the first spur, is subsequently regulated at a position much closer to the sheet conveyor portion by the second spur, and is sent to the image fixing portion along the sheet conveyor portion. Further, as the first spur, one having substantially the same diameter as that of a related art spur can be used. The second spur is disposed at a position which is a dead space in the related art. Accordingly, disposition of the first and second spurs does not lead to increase in size of the image forming apparatus.

Further, there may be adopted a structure in which the first spur is rotatably supported by a support portion provided to the image forming apparatus, and the second spur is rotatably supported by an arm rotatably mounted onto the support portion. Since the arm is rotatable with respect to the support portion as described above, when the leading edge of the sheet abuts on the second spur or in a case where a size of the curl of the sheet which is conveyed is changed, the arm rotates and the second spur moves. As a result, it is possible to prevent the sheet from being rubbed against or being caught by the support portion.

Further, the support portion may have a shaft hole formed therein and having an elliptical shape extending in a direction crossing the sheet conveying direction, and the first spur may be movable along the shaft hole. With this structure, the first spur moves along the shaft hole, thereby making it possible to alleviate an impact caused when the leading edge of the sheet abuts on the first spur or the like. Further, in response to the change in size of the curl of the sheet which is conveyed, the first spur moves so as to follow the sheet, thereby making it possible to prevent the sheet from being rubbed against or being caught by the support portion.

Further, the arm may be configured so that weights differing in weight can be detachably attached thereto.

Further, a movable range of the first spur and a movable range of the second spur, and directions thereof are made different from each other, thereby making it possible to set the movable ranges and directions which are suitable for positions in which the spurs are disposed. Further, by making away the spur is movable different, even when the spur of the same size is used, the movable range can be changed. Further, by replacement with an arm having a different weight, a force of pressing the sheet can be varied. Further, by replacement with an arm having a different length, the movable range can be changed.

By changing the mounting position of the support portion, a spur unit can be mounted to a mounting position which fits for use.

According to the present invention, it is possible to provide the image forming apparatus enabling conveying the sheet along the sheet conveyor portion without increasing the size of the image forming apparatus.

BRIEF DESCRIPTION OF THE DRAWINGS in the accompanying drawings.

DETAILED DESCRIPTION OF THE PREFERRED EMBODIMENTS

Next, a description will be made of an embodiment of the present invention with reference to the drawings.

Figure 1A:
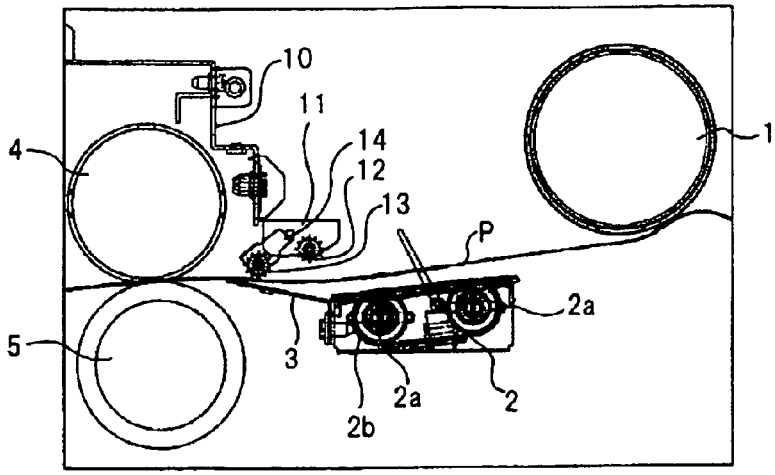
FIGS. 1A to 1C are views each showing a main structure of an image forming apparatus according to an embodiment of the present invention.
Figure 1B:
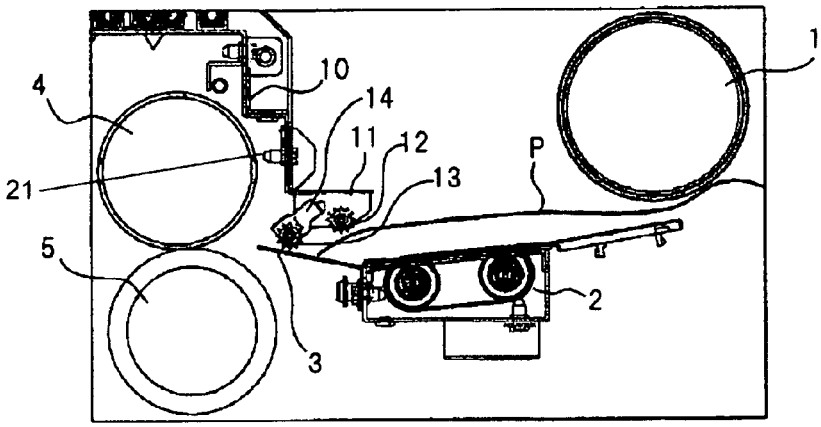
Figure 1C:
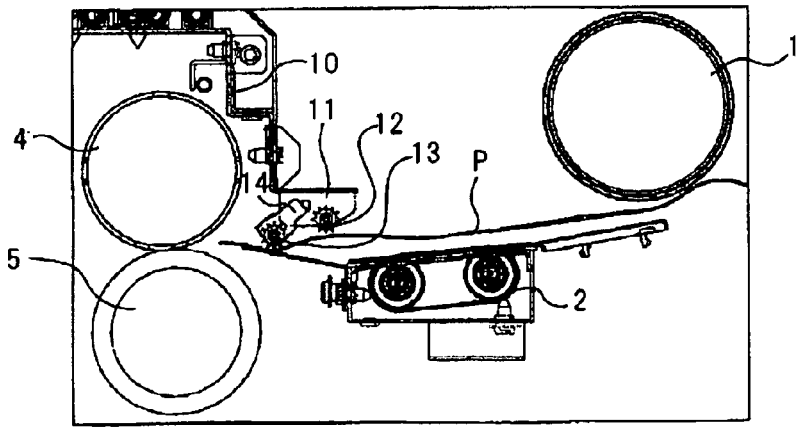

FIGS. 1A to 1C are views each showing a main structure of an image forming apparatus according to an embodiment of the present invention.

As shown in FIG. 1A, the image forming apparatus of this embodiment includes a photosensitive drum 1, and a fixing roller 4 and a pressure roller 5 constituting an image fixing portion. Between the photosensitive drum 1 and the image fixing portion, a sheet conveyor portion is formed by a conveying portion 2 for conveying a sheet P and a guide plate 3 for guiding the sheet P conveyed by the conveying portion 2 toward the image fixing portion. The conveying portion 2 according to this embodiment has two pulleys 2*a* and a belt 2*b* looped therearound. At least one of the pulleys 2*a* is rotated to rotate the belt 2*b*, thereby making it possible to send the sheet P conveyed on the belt 2*b* further downstream in a conveying direction.

At a position opposed to the guide plate 3, there are provided first and second spurs 12 and 13 for regulating the sheet P in a curled state or a floating state. The first spur 12 is rotatably supported by a support portion 11 fixed to a stay 10 of the image forming apparatus. The second spur 13 is rotatably supported by an arm 14 extending from the support portion 11. The first spur 12 is disposed at an interval from the guide plate 13. The second spur 13 is disposed the downstream in the sheet conveying direction with respect to the first spur 12 and at a position closer to the guide plate 3 than the first spur 12. Note that a plurality of spur units each including the first and second spurs 12 and 13, and the support portion 11 and the arm 14 for supporting those are arranged in the width direction of the sheet.

Figure 2A:
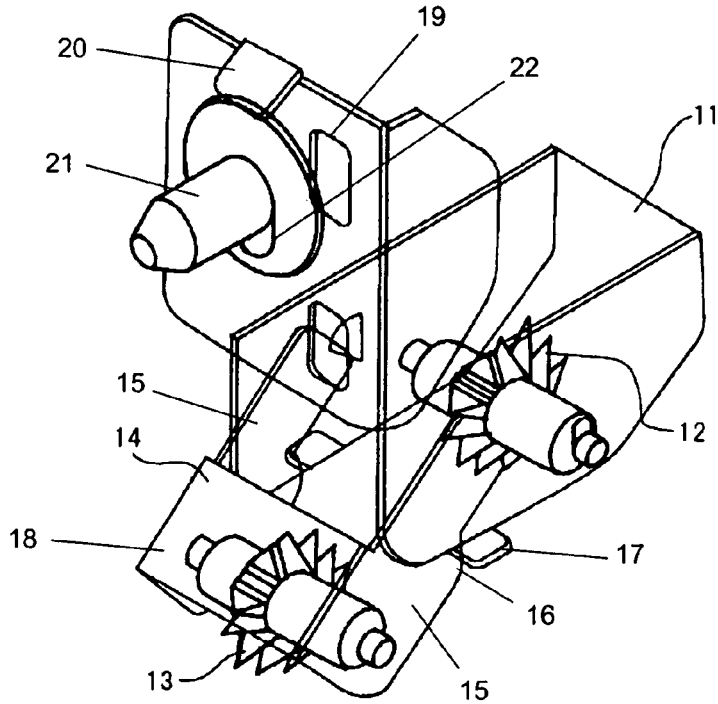
FIG. 2A is a view showing a structure of a unit including first and second spurs.
Figure 2B:
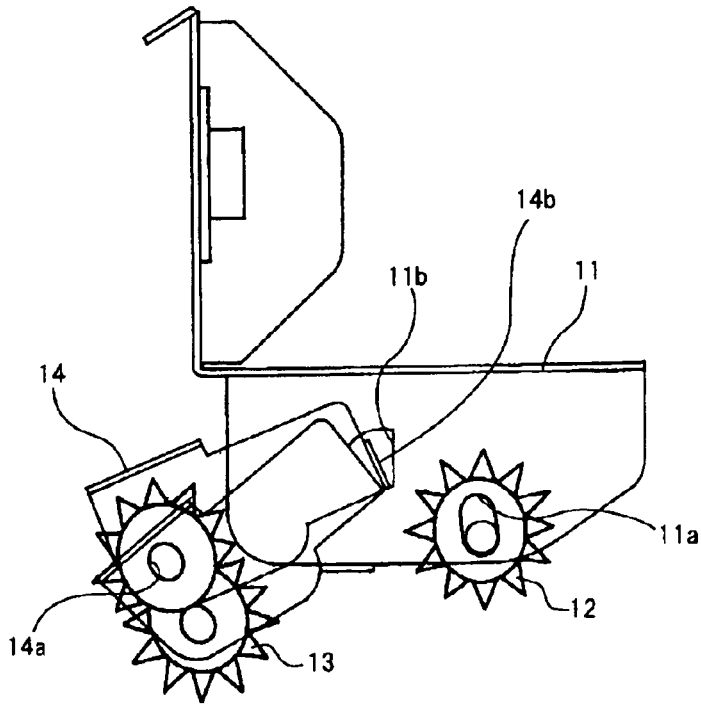
FIG. 2B is a view showing a support portion and an arm for supporting those.

Here, with reference to FIGS. 2 and 2B, a structure of the unit including the first and second spurs 12 and 13, and the support portion 11 and the arm 14 for supporting those is described in more detail. FIG. 2A is a see through perspective view of the unit. FIG. 2B is a see through side view of the unit.

The support portion 11 has shaft holes 11*a* for rotatably supporting the first pulley 12, formed therein. The shaft hole 11*a* is formed in an elliptical shape. The first spur 12 supported by the shaft holes 11*a* can move along the elliptical shaft holes 11*a*.

In one of end portions of the arm 14, shaft holes 14*a* for rotatably supporting the second spur 13 are formed, and the second spur 13 is supported by the shaft holes 14*a*. Further, in another of the end portions of the arm 14, claw portions 14*b* are formed. The claw portions 14*b* are locked in arm support holes 11*b* formed in the support portion 11. As a result, the arm 14 is made rotatable with respect to the support portion 11 with the claw portions 14*b* serving as a center. In a normal state, the arm 14 is disposed at a position on a lower side by its own weight as shown in FIG. 2B. When the sheet P which is conveyed abuts on the second spur 13 or when, in order to prevent, generation of wrinkles in the sheet P, the sheet P is conveyed while being taut between the photosensitive drum 1 and the image fixing portion 4, 5, the second spur 13 is lifted up by, the sheet P to allow the arm 14 to rotate toward a position, on an upper side shown in FIG. 2B.

The shaft hole 11*a* is elongated upwardly so as to prevent the first spur 12 from reaching a movable limit in a case where the sheet P is conveyed while being taut between the photosensitive drum 101, and the fixing roller 104 and the pressure roller 105. Further, similarly, the arm support hole 11*b* having a partially circular arc shape is provided so as to prevent the second spur 13 from reaching the movable limit. When the spur reaches the movable limit, unfixed toner is removed or the sheet P is damaged. This structure is employed because those problems have to be avoided. Further, when the sheet P is conveyed while being taut, the first spur 12 or the second spur 13 continuously guides the sheet P while coming into contact with and following the sheet P. Even when the sheet P becomes wavy etc., the spur is movable therewith, so such a problem that the unfixed toner is scraped off can be suppressed.

Next, a description will be made of an operation of the image forming apparatus of this embodiment.

A surface of the photosensitive drum 1 is uniformly charged by a charger (not shown) and an electrostatic latent image is formed by an exposure device (not shown). The electrostatic latent image is developed by a developing device (not shown) to be a toner image. The toner image is transferred onto the sheet P from the photosensitive drum 1. The sheet P on which the unfixed toner image is placed is conveyed on the sheet conveyor portion to the downstream in the conveying direction by the conveying portion 2 or the like.

FIG. 1B shows a state where the sheet is conveyed on the sheet conveyor portion while being curled downwardly.

Figure 3A:
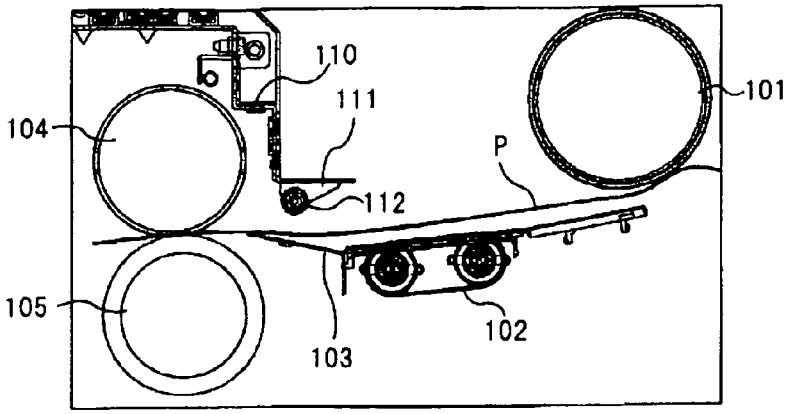
Fig.3A PRIOR ART
FIG. 3A to 3C are views each showing a main structure of a related-art image forming apparatus.
Figure 3B:
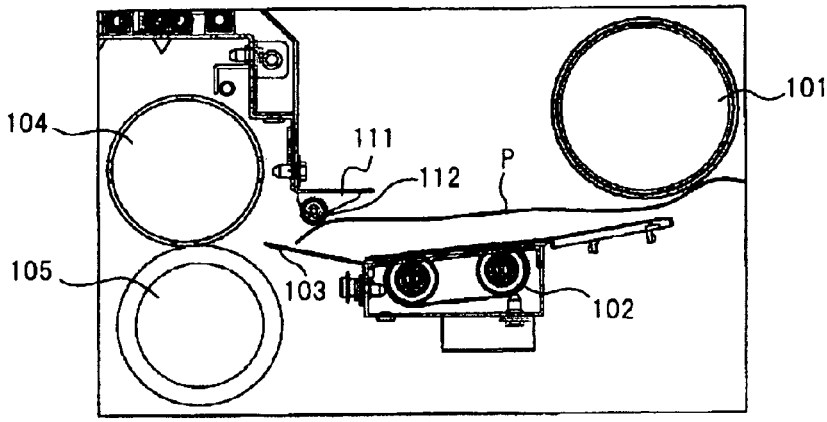
Fig.3B PRIOR ART

Even in a case where the sheet P is conveyed on the sheet conveyor portion while being curled downwardly as shown in FIG. 1B, the sheet P is regulated by the first spur 12 toward the guide plate 3, so, the sheet P is prevented from being brought into contact with or being caught by the support portion 11. A diameter of the first spur 12 is substantially the same as a diameter of the spur 112 according to the related art shown in FIGS. 3A to 3B.

The sheet P regulated toward the guide plate 3 by the first spur 12 is further conveyed to the downstream in the conveying direction, and is subsequently regulated by the second spur 13 as shown in FIG. 1C. The second spur 13 is arranged closer to the guide plate 3 than the first spur 12, and is adjacent to the guide plate 3. Therefore, the sheet P regulated by the second spur 13 is conveyed along the guide plate 3 and the leading edge of the sheet P is sent to the nip portion between the fixing roller 4 and the pressure roller 5.

The sheet P on which the unfixed toner image is placed is heated and pressurized by the image fixing portion composed of the fixing roller 4 and the pressure roller 5, thereby fixing the toner image.

Figure 3C:
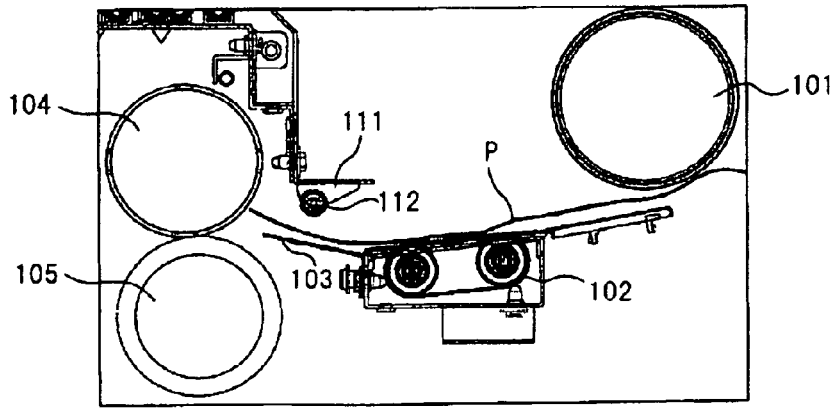
Fig.3C PRIOR ART

In this manner, in the image forming apparatus of this embodiment, by the first spur 12 and the second spur 13 which is arranged on the downstream in the sheet conveying direction with respect to the first spur 12 and closer to the guide plate 3 than the first spur 12, the sheet P can be conveyed along the guide plate 3. As a result, the leading edge of the sheet P can favorably be sent to the nip portion between the fixing roller 4 and the pressure roller 5. Further, the diameter of the first spur 12 is substantially the same as the diameter of the spur 112 according to the related art in the FIGS. 3A to 3C and the second spur 13 is arranged at the position which is a dead space in the related art, so the image forming apparatus is not increased in size due to the arrangement of the spurs 12 and 13.

The shaft hole 11*a* of the support portion 11 for supporting the first spur 12 has an elliptical shape elongated in a direction crossing the sheet conveying direction. Accordingly, the first spur 12 moves along the shaft holes 11*a*, thereby making it possible to alleviate an impact caused when the leading edge of the sheet P abuts on the first spur 12 or the like. Further, according to a variation in size of the curl of the sheet P which is conveyed, the first spur 12 moves following the sheet P, thereby making it possible to prevent the sheet P from being rubbed against or being caught by the support portion 11.

Further, the second spur 13 which is supported by the arm 14 which is rotatable about the arm support holes 11*b* of the support portion 11 presses down the sheet P on the guide plate 13 by own weights of the arm 14 and the second spur 13. The weights of the arm 14 and the second spur 13 can be appropriately selected according to flexural rigidity determined based on a material or thickness of the sheet P. There may be adopted a structure in which, as means therefor, by arbitrary locking means such as screw fixation or clip fixation, weights (not shown) differing in weight may be detachably attached to the arm 14. Further, by changing a length of the arm 14, it is possible to adjust the weight of the arm 14 itself, or an interval between the first spur 12 and the second spur 13, and an interval between the second spur 13 and the guide plate 3.

The arm 14 is formed by bending a single plate material which is cut out in a predetermined shape. Bent portions which are formed by bending both ends of a top plate portion 18 in a center portion of the plate material constitute arm portions 15. A weight of the top plate portion 18 itself for pressing the second spur 13 toward the sheet P can be changed by changing a thickness or width thereof or by mounting a weight by using a magnet.

The arm 14 has the claw portions 14*b* hooked on the arm support holes 11*b* having a partially circular arc shape of the support portion 11 from both outer sides thereof. The claw portions 14*b* are formed by bending the arm portions 15, respectively, in a key shape to a side on which the arm portions 15 face each other. End portions of the claw portions 14*b* are movable along circular arc walls of the arm support holes 11*b*. The claw portions 14*b* operate along the circular arc walls, so the arm 14 and the second spur 13 are movable in the circular arc shape.

The arm 14 has shaft holes 14*a* for supporting the second spur 13. The shaft holes 14*a* are through holes opened in both the arm portions 15. According to a length of the arm portions 15 and a shape of the arm support holes 11*b*, a movable range of the second spur 13 is determined. Further, the arm 14 is engaged by only hooking the claw portions 14 on the arm support holes 11*b* with the arm portions 15 being opened, so the replacement is easier than in a structure employing a support shaft.

Further, each of the arm portions 15 is formed with a protruding portion 16. To the support portion 11, in a direction perpendicular to a movable direction of the arm 14, stopper portions 17 for inhibiting movement of the arm 14 are provided. The stopper portions 17 are formed by bending ends of the support portion 11. The protruding portions 16 and the stopper portions 17 abut on each other, thereby limiting a movable range of the arm. Replacement with the arm 14 having the protruding portions 16 at different positions can be performed with respect to the support portion 11. By changing the arm 14, the spurs having different movable ranges can be replaced with each other for many purposes.

By bending an end portion of the support portion 11, a bent portion 20 is provided. When the spur unit is mounted onto the stay 10, the bent portion 20 is hooked onto a hole provided in the stay 10 to enable mounting the spur unit to the stay 10 by a screw 21 while preventing the spur unit from falling off.

The support portion 11 is bent at a right angle, and on one side, the spurs are mounted, and another side is mounted onto the stay 10. For mounting the support portion 11 onto the stay 10, the screw 21 is employed. Here, there is provided a screw hole 22 having an oblong hole shape for passing the screw 21 therethrough. Since the screw hole 22 is of the oblong hole shape, a mounting position can be changed along the oblong hole. With this structure, an interval between the spur unit and the sheet P can easily be varied. The support portion 11 is further provided with positioning holes 19. The positioning holes 19 each have a substantially rectangular shape. For example, circular columnar protrusions are provided to the stay 10 and the positioning holes 19 are formed to have such a width of short sides that an outer periphery of the circular column is brought into contact with side walls of long sides. By providing two sets of those, the spur unit becomes movable with respect to the stay 10 only in a longitudinal direction of the positioning holes 19, and the spur unit is fixed to a desired position, thereby determining the position thereof.

In FIGS. 1A to 1C, the spur unit is mounted onto the stay 10. According to use, replacement with the arm 14 a different movable range can be performed, and distances between the spur and the sheet P can be changed. The first spur 12 can move up and down owing to the shaft holes 11*a*. The second spur 13 can be moved by the arm 14. The first spur 12 mainly guides the sheet P so as to prevent the sheet P from abutting on the support portion 11. On the other hand, the second spur 13 guides the sheet P at a position closer to the guide plate 3 than the first spur 12. According to a state of curl of the sheet P, the second spur 13 is movable to a larger degree than the first spur 12. In order to increase the movable range while downsizing the spur, the arm 14 is used. There can be realized a structure in which even when the spur of the same size is used, the movable range is made different. As a result, the spur does not have to be changed according to the use.

Since the arm 14 is movable about the arm support holes 11*b* of the support portion 11, when the leading edge of the sheet P abuts on the second spur 13 or in a case where a size of the curl of the sheet P which is conveyed varies, the arm 14 rotates to move the second spur 13. As a result, it is possible to prevent the sheet P from being rubbed against or being caught by the arm 14 or the support portion 11.

Note that, FIGS. 1B and 1C each illustrate the case where the sheet P is conveyed on the sheet conveyor portion while being curled downwardly, even in the case where the sheet P is conveyed on the sheet conveyor portion while being curled upwardly, the sheet P can similarly be regulated so as to be aligned along the guide plate 3 by the first and second spurs 12 and 13.

MODIFIED EXAMPLE

While the above-mentioned description is made of the structure in which the arm 14 can rotate about the arm support holes 11*b*, there may be adopted a structure in which the arm 14 is fixed to a lower position as shown in FIG. 2B. Even with the structure in which the arm 14 is fixed, the sheet P can be regulated so as to be aligned along the guide plate 3 by the first and second spurs 12 and 13.

Further, while the above-mentioned description is made of the structure with which the sheet P is regulated so as to be aligned along the guide plate 3 by the own weights of the arm 14 and the second spur 13, there may be adopted a structure in which the arm 14 is biased to the lower position by biasing means such as a spring. With this structure, the sheet P can be regulated so as to be aligned along the guide plate 3 more reliably. It is preferable that a strength of the biasing means be appropriately adjustable according to flexural rigidity determined based on the material or thickness of the sheet P to be used. The adjustment of the strength of the biasing means can be realized, for example, by adopting a structure in which replacement of the biasing means of different spring constants is possible with respect to the arm 14 or by adopting a structure in which the spring constant of the biasing means can be adjusted.

Further, while the above-mentioned description is made of the structure with which the sheet P is conveyed in a substantially horizontal direction from the photosensitive drum 1 toward the nip portion between both the rollers 4 and 5, the sheet conveying direction is not limited to this. The first and second spurs 12 and 23 of this embodiment can also be applied to a structure with which the sheet P is conveyed in a vertically downward direction from the photosensitive drum 1 toward the nip portion between both the rollers 4 and 5. In this case, a weight (not shown) hanging in the vertically downward direction is fixed in the vicinity of the claw portion 14*b* of the arm 14, thereby making it possible to hold the second spur 23 at a position in the vicinity of the guide plate 13 by its own weight.

What is claimed is:

1. An image forming apparatus comprising:

an image transferring portion for transferring an image onto a sheet;

an image fixing portion for fixing the transferred image to the sheet;

a sheet conveyor portion arranged between the image transferring portion and the image fixing portion for conveying the sheet in a sheet conveying direction;

a support portion having an elliptical-shaped shaft hole extending in a direction crossing the sheet conveying direction;

an arm rotatably mounted on the support portion;

a first spur disposed at a position opposed to and spaced-apart from the sheet conveyor portion for regulating movement of the sheet, the first spur being rotatably supported by the support portion and movable along the shaft hole under only the weight of the first spur in the direction of the force of gravity; and a second spur disposed at a position opposed to and spaced-apart from the sheet conveyor portion downstream in a sheet conveying direction of the first spur and closer to the sheet conveyor portion than the first spur, the second spur being rotatably supported by the arm for regulating movement of the sheet and having a movable range larger than a movable range of the first spur.

2. An image forming apparatus according to claim 1; wherein the arm is configured so that weights differing in weight can be detachably attached thereto.

3. An image forming apparatus according to claim 1; wherein the first and second spurs undergo movement in first and second directions, respectively.

4. An image forming apparatus according to claim 3; wherein the first spur undergoes linear movement along the shaft hole of the support portion; and wherein the second spur undergoes movement in a circular arc manner along with rotation of the arm.

5. An image forming apparatus according to claim 4; wherein a diameter of the first spur is substantially the same as a diameter of the second spur.

6. An image forming apparatus according to claim 4; wherein the support portion is configured such that arms of different weights can be selectively rotatably mounted thereto so that a force pressing down the sheet by the second spur can be made variable.

7. An image forming apparatus according to claim 4; wherein the support portion is configured such that arms of different lengths can be selectively rotatably mounted thereto so that the movable range of the second spur can be made variable.

8. An image forming apparatus according to claim 1; further comprising a stay; and wherein the support portion is non-movably mounted to the stay and the first spur is directly mounted to the support portion.

9. An image forming apparatus comprising;

an image transferring portion for transferring an image onto a sheet;

an image fixing portion for fixing the transferred image to the sheet;

a sheet conveyor portion arranged between the image transferring portion and the image fixing portion for conveying the sheet in a sheet conveying direction;

a support portion having a plurality of elliptical-shaped shaft holes extending in a direction crossing the sheet conveying direction;

an arm rotatably mounted on the support portion; and a plurality of spur units for regulating movement of the sheet in the sheet conveying direction, each of the spur units having a first spur and a second spur disposed at a position opposed to and spaced-apart from the sheet conveyor portion, the first spurs being rotatably supported by the support portion and movable along the respective shaft holes under only the weight of the first spurs in the direction of the force of gravity, the second spurs being disposed downstream in the sheet conveying direction and closer to the sheet conveyor portion than the first spurs, the second spurs being rotatably supported by the arm and having a movable range larger than a movable range of the first spurs.

10. An image forming apparatus according to claim 9; wherein the first spurs undergo linear movement along the respective shaft holes of the support portion; and wherein the second spurs undergo movement in a circular arc manner along with rotation of the arm.

11. An image forming apparatus according to claim 10; wherein a diameter of the first spurs is substantially the same as a diameter of the second spurs.

12. An image forming apparatus according to claim 9; further comprising a stay; and wherein the support portion is non-movably mounted to the stay and the first spurs are directly mounted to the support portion.

13. An image forming apparatus comprising:

an image transferring portion for transferring an image onto a sheet;

an image fixing portion for fixing the transferred image to the sheet;

a sheet conveyor portion arranged between the image transferring portion and the image fixing portion for conveying the sheet in a sheet conveying direction;

a support portion mounted in non-movable manner during operation of the image forming apparatus, the support portion having a shaft hole;

an arm rotatably mounted on the support portion;

a first spur disposed at a position opposed to and spaced-apart from the sheet conveyor portion for regulating movement of the sheet, the first spur being directly rotatably supported by the support portion and movable along the shaft hole under only the weight of the first spur in the direction of the force of gravity; and a second spur rotatably supported by the arm for regulating movement of the sheet and disposed at a position opposed to and spaced-apart from the sheet conveyor portion downstream in a sheet conveying direction of the first spur and closer to the sheet conveyor portion than the first spur.

14. An image forming apparatus according to claim 13; wherein the second spur has a movable range larger than a movable range of the first spur.

15. An image forming apparatus according to claim 13; wherein the shaft hole is elliptical-shaped and extends in a direction crossing the sheet conveying direction.

16. An image forming apparatus according to, claim 13; wherein the first spur undergoes linear movement along the shaft hole of the support portion; and wherein the second spur undergoes movement in a circular arc manner along with rotation of the arm.

17. An image forming apparatus according to claim 13; wherein a diameter of the first spur is substantially the same as a diameter of the second spur.

18. An image forming apparatus according to claim 13; further comprising a stay; and wherein the support portion is non-movably mounted to the stay.

* * * * *